US005092251A

United States Patent [19]

Hamaker et al.

[11] Patent Number: 5,092,251

[45] Date of Patent: Mar. 3, 1992

[54] LIQUID CONTAINMENT PALLET

[75] Inventors: Peter G. Hamaker, Beaufort, S.C.; Seymour Zilbert, Demarest, N.J.

[73] Assignee: Bergen Barrel & Drum Co., Keary, N.J.

[21] Appl. No.: 704,973

[22] Filed: May 23, 1991

[51] Int. Cl.[5] ..... B32B 9/00

[52] U.S. Cl. ..... 108/51.1; 108/901

[58] Field of Search ..... 108/51.1, 901, 29; 206/386, 596, 598, 599

[56] References Cited

U.S. PATENT DOCUMENTS

| | | | |
|---|---|---|---|
| 3,968,895 | 7/1976 | Barnes, Jr. et al. | 206/596 X |
| 4,263,855 | 4/1981 | Lawlor | 108/901 X |
| 4,606,278 | 8/1986 | Shuert | 108/51.1 |
| 4,838,178 | 6/1989 | Chriske et al. | 108/51.1 X |
| 4,930,632 | 6/1990 | Eckert et al. | 108/901 X |
| 5,020,667 | 6/1991 | Bush | 108/51.1 X |
| 5,036,976 | 8/1991 | Sechler et al. | 108/51.1 X |

FOREIGN PATENT DOCUMENTS

| | | | |
|---|---|---|---|
| 1081630 | 7/1980 | Canada | 108/901 |

*Primary Examiner*—Peter A. Aschenbrenner
*Attorney, Agent, or Firm*—Samuelson & Jacob

[57] ABSTRACT

A pallet for supporting liquid-containing industrial drums during storage and transportation and having the ability to collect and contain liquid leaked or otherwise spilled from the supported industrial drums includes a platform for supporting the industrial drums, and a basin beneath the platform for collecting the spilled liquid, the platform and the basin being rotationally molded of a synthetic polymeric material so as to be unitary with one another, the platform having an undulate cross-sectional configuration including a plurality of upper crests and lower troughs between the crests establishing a reinforcing support structure of predetermined area for receiving the industrial drums on the platform, the basin including a reservoir located beneath the platform, and a plurality of holes passing through the platform and communicating with the reservoir, the holes being located in the troughs such that the spilled liquid will drain into the troughs and then through the holes to enter the reservoir for containment within the basin of the pallet.

24 Claims, 2 Drawing Sheets

FIG. 1.
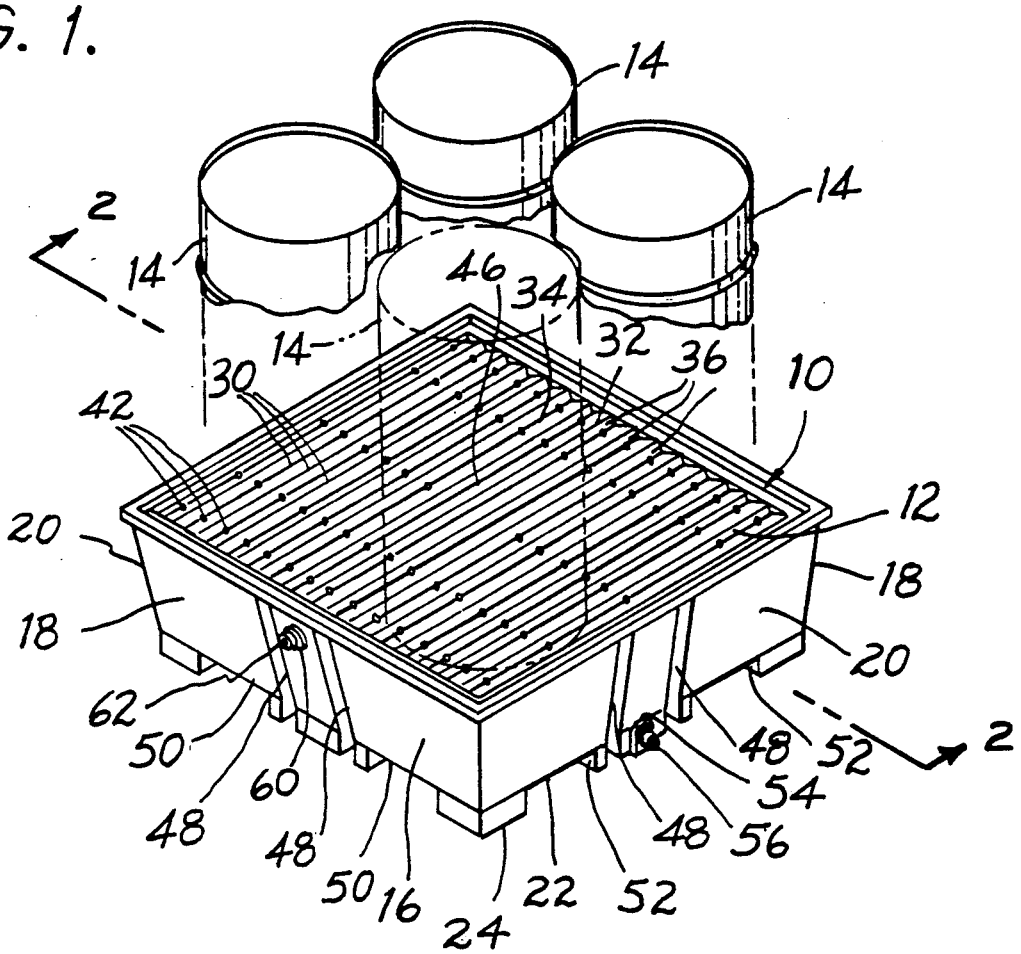
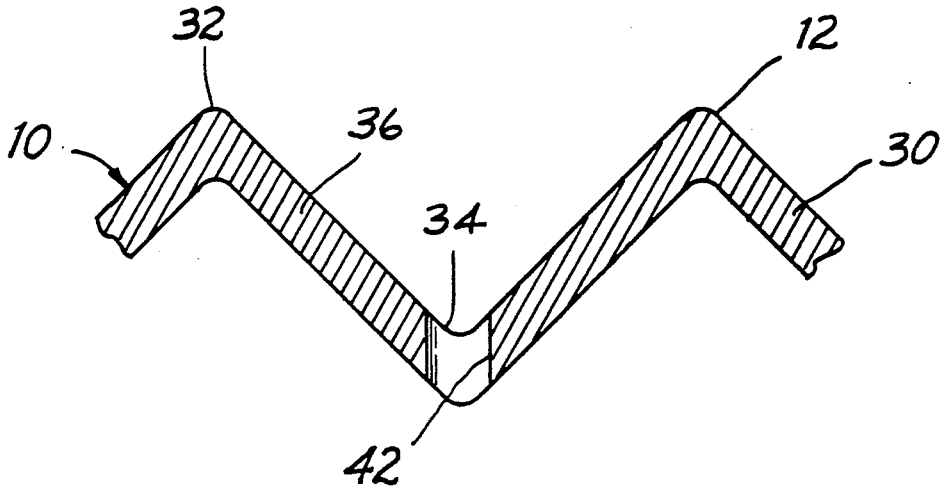
FIG. 3.

FIG. 2.
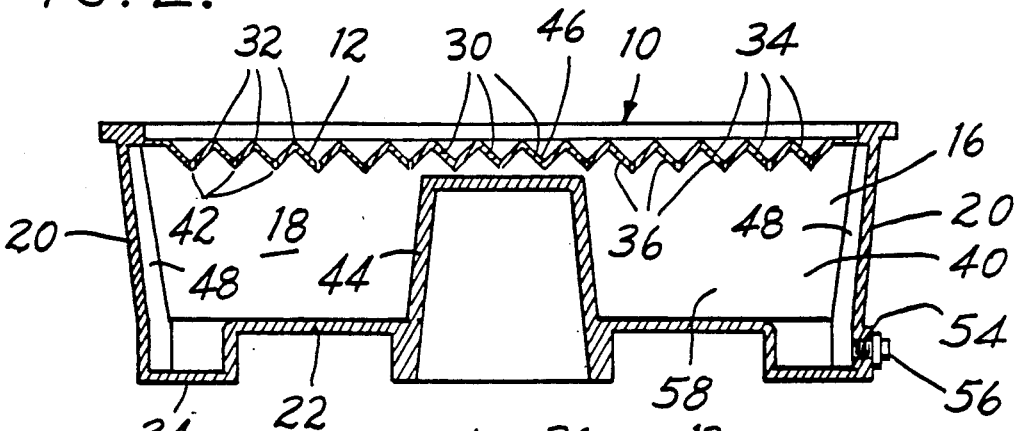
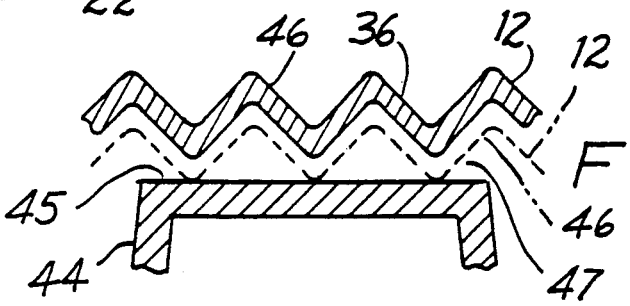
FIG. 4.
FIG. 5.
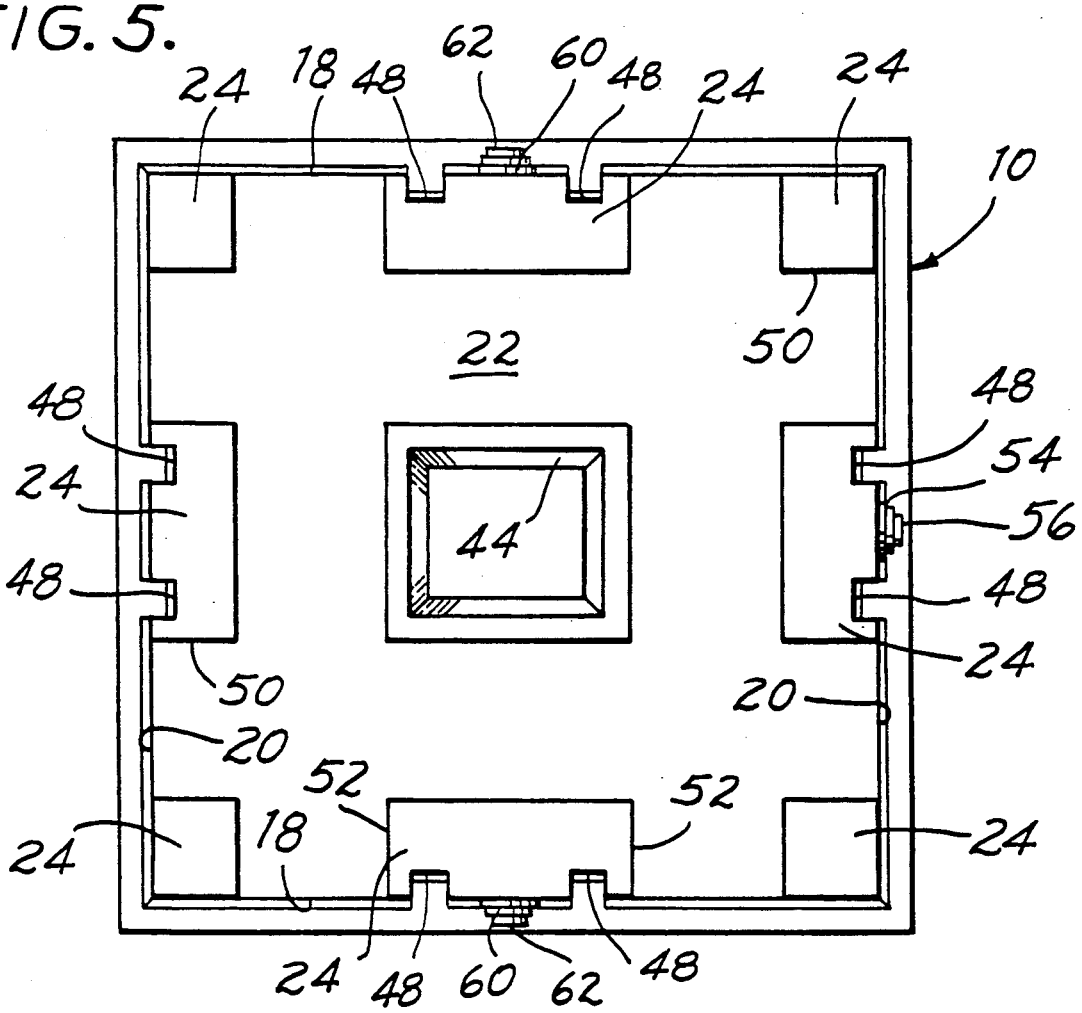

LIQUID CONTAINMENT PALLET

The present invention relates generally to pallets and pertains, more specifically, to pallets for supporting liquid-containing industrial drums during transportation and storage and having the ability to collect and contain liquid leaked or otherwise spilled from the supported industrial drums.

The increasing emphasis on the proper containment and disposal of liquid chemical products has led to the development of a wide variety of devices for collecting liquids leaked or spilled from industrial drums during storage and transportation of the drums. Trays have been constructed for placement beneath industrial drums for the purpose of collecting and disposing of various liquid chemical products leaked or spilled from the drums supported above the trays. For example, U.S. Pat. No. 4,930,632 illustrates a containment tray used in connection with a platform for supporting industrial drums and collecting liquids leaked from the drums.

The present invention provides a pallet of simplified construction which not only supports industrial drums for transportation and storage, but collects liquids leaked or spilled from the industrial drums supported on the pallet and facilitates containment of the leaked or spilled liquid within the pallet for ready and appropriate disposal. As such, the present invention attains several objects and advantages, some of which may be summarized as follows: Provides a pallet of unitary construction, having high strength for supporting a plurality of industrial drums containing liquid and including a facility for collecting and containing liquid leaked or spilled from the drums supported on the pallet; enables the construction of a pallet having a capacity great enough to accommodate a significant volume of liquid, and at least as great as the volume of one of the industrial drums supported on the pallet so as to collect and contain all liquids, even in the event of a catastrophic failure of one of the drums supported on the pallet; assures that the leaked or spilled liquid collected in the pallet will tend to be contained within the pallet, pending proper disposal, during transportation, as well as during storage and handling of the pallet itself; enables ready drainage and emptying of the collected and contained liquid from the pallet and ease of cleaning for an extended useful service life, with minimal maintenance; isolates hazardous liquids collected within the pallet from the surroundings for true containment and added safety pending disposal of the collected liquid; supports a plurality of industrial drums, or a .like load, in a more stable arrangement on the pallet; provides a pallet which is rugged enough for many reuses, and is recycled readily when no longer serviceable; enables relatively economical manufacture in large quantities of uniform high quality for widespread use.

The above objects and advantages, as well as further objects and advantages, are attained by the present invention which may be described briefly as a pallet for supporting liquid-containing industrial drums during storage and transportation and having the ability to collect and contain liquid leaked or otherwise spilled from the supported industrial drums, the pallet comprising: a platform for supporting the industrial drums, and a basin beneath the platform for collecting the spilled liquid, the platform and the basin being rotationally molded of a synthetic polymeric material so as to be unitary with one another; the platform having an undulate cross-sectional configuration including a plurality of upper crests and lower troughs between the crests establishing a reinforcing support structure of predetermined area for receiving the industrial drums thereon; the basin including a reservoir located beneath the platform; and a plurality of holes passing through the platform and communicating with the reservoir, the holes being located in the troughs such that the spilled liquid will drain into the troughs and then through the holes to enter the reservoir for containment within the basin of the pallet.

The invention will be understood more fully, while still further objects and advantages will become apparent, in the following detailed description of a preferred embodiment of the invention illustrated in the accompanying drawing, in which:

FIG. 1 is a pictorial perspective view illustrating a pallet constructed in accordance with the present invention, in use;

FIG. 2 is a lateral cross-sectional view of the pallet, taken along line 2—2 of FIG. 1;

FIG. 3 is an enlarged fragmentary cross-sectional view of a portion of FIG. 2;

FIG. 4 is an enlarged fragmentary cross-sectional view of another portion of FIG. 2; and FIG. 5 is a bottom plan view of the pallet.

Referring now to the drawing, and especially to FIG. 1 thereof, a pallet constructed in accordance with the invention is illustrated generally at 10 and is seen to include a platform 12 for supporting a plurality of industrial drums, as depicted at 14. In this instance, pallet 10 is constructed to support four industrial drums 14 and the industrial drums 14 are of standard cylindrical configuration having a capacity of fifty-five gallons. A basin 16 is located beneath the platform 12, and the industrial drums 14 on the platform 12, and extends throughout the full length and width of the platform 12, basin 16 including opposite end walls 18 and opposite side walls 20 depending from the platform 12 around the outer perimeter of the platform 12, and a bottom wall 22 having an outer basal surface 24 upon which the pallet 10 rests.

As best seen in FIG. 2, as well as in FIG. 1, platform 12 has an undulate cross-sectional configuration including a plurality of undulations 30 extending longitudinally along the length of the platform 12 between the opposite end walls 18, the undulations 30 providing upper crests 32 and lower troughs 34 alternating across the lateral width of the platform 12, between the opposite side walls 20. In the illustrated embodiment, the undulations 30 establish ribs 36 which extend longitudinally continuously along the entire platform 12, from adjacent one end wall 18 to adjacent the other end wall 18, with the upper crests 32 located on the ribs 36 and themselves extending continuously along the length of the platform 12, and the ribs 36 are spaced laterally across the width of the platform 12 so that the lower troughs 34 extend continuously along the length of the platform 12 between the ribs 36.

The end walls 18, the side walls 20 and the bottom wall 22 of the basin 16 establish a reservoir 40 within the basin 16, beneath the platform 12, and a plurality of holes 42 pass through the platform 12 and communicate with the reservoir 40. The holes 42 are located in the troughs 34 such that any liquid leaked or spilled from the industrial drums 14 supported on the platform 12 will drain into the troughs 34 and then through the holes 42 to enter the reservoir 40 for containment within the basin 16 of the pallet 10. The capacity of the reservoir 40 is made large enough to contain the contents of at least two of the industrial drums 14 so that even upon a catastrophic failure in which all of the contents of one or two of the industrial drums 14 is spilled, the pallet 10 will contain the spill. Thus, the end walls 18 and the side walls 20 extend upwardly a sufficient distance to establish the necessary volume in the reservoir 40.

Pallet 10 is rotationally molded of a synthetic polymeric material, such as a medium density or a high density polyethylene, with the platform 12 molded unitary with the basin 16 in a single unitary body. The ribs 36 of the platform 12 extend all the way along the length of the pallet 10 and are unitary with the platform 12 so as to provide a reinforcing configuration which supports the load of the four industrial drums 14. As best seen in FIG. 3, as well as in FIG. 2, the ribs 36 preferably have a generally V-shaped cross-sectional configuration for added strength. The unitary construction in which the ribbed platform 12 is molded unitary with the walls 18, 20 and 22 of the basin 16, and preferably unitary with the end walls 18 and the side walls 20 throughout the entire outer perimeter of the platform 12, attains the necessary strength not only for supporting the load of the industrial drums 14, but in withstanding the rigors of service in the field. Added support for the platform 12, as well as added structural strength for the pallet 10, is provided by a post 44 molded unitary with the basin 16 and extending upwardly from the bottom wall 22 toward the platform 12, where the post 44 terminates adjacent the platform 12, at a generally central location, intermediate the end walls 18 and the side walls 20, so as to provide a generally centrally located support surface 45 for the platform 12 at a corresponding generally central area 46 of the platform 12. In the illustrated embodiment of the invention, a small gap 47 is located between the platform 12 and the support surface 45 of the post 44, when there is no load on the platform 12, as seen in full lines in FIG. 4. The gap 47 facilitates manufacture of the pallet 10 by rotational molding in a single, unitary construction. However, a further functional advantage is realized, namely, upon placement of a load on the platform 12, the platform 12 will flex slightly until central area 46 of the platform 12 rests upon the support surface 45 provided by the post 44, thereby closing the gap 47, as illustrated in phantom in FIG. 4. This slight flexing of the platform 12 when under load, as permitted by the presence of gap 47, results in a slightly concave configuration in the platform 12, under load, so that the load is biased inwardly, tending to tilt the load away from the outer perimeter of the platform 12. In the present example, the slight inward tilting of the four industrial drums 14 toward one another, as effected by the closing of gap 47, lends added stability to the total load carried by the pallet 10. Preferably, no holes 42 are placed in the central area 46. Further reinforcement of the pallet 10 construction is provided by reinforcing columns 48 molded unitary with the end walls 18 and the side walls 20.

The holes 42 are very small in diameter in relation to the dimensions of the pallet 10 and are spaced apart from one another to occupy a relatively small portion of the total area of the platform 12 so that while liquid is drained readily into each trough 34 and through the holes 42 to the reservoir 40, liquid contained in the reservoir 40 cannot pass readily out of the reservoir 40 back through the holes 42. In this manner, collected liquid is contained in the reservoir 40 against sloshing out of the reservoir 40 during transport and ordinary handling of the pallet 10, thereby isolating the contained liquid from the surroundings for added safety and for protecting against unwanted spillage from the basin 16. The ribbed configuration, with the crests 32 and troughs 34, thus assists in the desired containment and the prevention of unwanted spillage by tending to confine collected liquid within the reservoir 40 and by impeding splashing of any liquid which might well up into the troughs 34 during transport and handling of the pallet 10. In this manner, the troughs 34 also serve as traps for liquid which might lie on the platform 12. As an example of typical dimensions, pallet 10 has been constructed with an overall length and width of about forty-nine inches each, with a platform 12 having a length and a width of about forty-four inches each, while the basin 16 has a height of about fifteen inches, and the seventy-two holes 42 each have a diameter of about three-eighths of an inch. The nominal wall thickness is about three-tenths of an inch. Crests 32 are spaced apart laterally by about three inches and troughs 34 are about one and one-quarter inch deep. Gap 47 is about one-sixteenth of an inch to about one-eighth of an inch.

Pallet 10 is intended to be transported by means of a fork-lift having a pair of parallel lifting tines, as is common in the handling of palleted loads. Turning now to FIG. 5, as well as to FIGS. 1 and 3, in order to accommodate the tines of a fork-lift (not shown), pallet 10 is provided with first channels 50 extending longitudinally along the length of the pallet 10 adjacent the basal surface 24 of the basin 16 and second channels 52 extending laterally across the width of the pallet 10 adjacent the basal surface 24. Thus, pallet 10 allows for four-way entry of the tines of a fork-lift. Accordingly, all conventional storage and handling techniques are made available, using pallet 10.

In order to drain collected liquid from the reservoir 40, a drain opening 54 extends through one of the side walls 20, adjacent the bottom wall 22. Normally a threaded drain plug 56 closes the drain opening 54 to maintain the containment. When liquid is to be drained from the basin 16, drain plug 56 is removed to open the drain opening 54 and drain the liquid. The interior 58 of the pallet 10 may be cleaned, as required, through the use of access openings 60, one access opening 60 being placed in each end wall 18. When not in use, access openings 60 are closed with threaded closure plugs 62. When it is desired to clean the interior 58, one or both closure plugs 62 are removed so as to admit a cleaning medium, such as steam, to effect selective cleaning of the interior 58 of the pallet 10. Should the pallet 10 become damaged or unserviceable for any reason, the entire pallet 10 can be recycled in a manner similar to the recycling of synthetic polymeric containers.

It will be seen that the pallet of the present invention attains the several objects and advantages summarized above, namely: Provides a pallet of unitary construction, having high strength for supporting a plurality of industrial drums containing liquid and including a facility for collecting and containing liquid leaked or spilled from the drums supported on the pallet; enables the construction of a pallet having a capacity great enough to accommodate a significant volume of liquid, and at least as great as the volume of one of the industrial drums supported on the pallet so as to collect and contain all liquids, even in the event of a catastrophic failure of one of the drums supported on the pallet; assures that the leaked or spilled liquid collected in the pallet will tend to be contained within the pallet, pending proper disposal, during transportation, as well as during storage and handling of the pallet itself; enables ready drainage and emptying of the collected and contained liquid from the pallet and ease of cleaning for an extended useful service life, with minimal maintenance; isolates hazardous liquids collected within the pallet from the surroundings for true containment and added safety pending disposal of the collected liquid; supports a plurality of industrial drums, or a like load, in a more stable arrangement on the pallet; provides a pallet which is rugged enough for many reuses, and is recycled readily when no longer serviceable; enables relatively economical manufacture in large quantities of uniform high quality for widespread use.

It is to be understood that the above detailed description of a preferred embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. A pallet for supporting liquid-containing industrial drums during storage and transportation and having the ability to collect and contain liquid leaked or otherwise spilled from the supported industrial drums, the pallet comprising:

a platform for supporting the industrial drums, and a basin beneath the platform for collecting the spilled liquid, the platform and the basin being rotationally molded of a synthetic polymeric material so as to be unitary with one another;

the platform having an undulate cross-sectional configuration including a plurality of upper crests and lower troughs between the crests establishing a reinforcing support structure of predetermined area for receiving the industrial drums thereon;

the basin including a reservoir located beneath the platform; and a plurality of holes passing through the platform and communicating with the reservoir, the holes being located in the troughs such that the spilled liquid will drain into the troughs and then through the holes to enter the reservoir for containment within the basin of the pallet.

2. The invention of claim 1 wherein the platform includes an outer perimeter, and the basin includes a bottom wall, and end walls and side walls extending between the bottom wall and the platform, along the outer perimeter of the platform, the platform being molded unitary with the end walls and the side walls along the entire outer perimeter of the platform.

3. The invention of claim 1 wherein the platform includes an outer perimeter, and the basin includes a bottom wall, and end walls and side walls extending between the bottom wall and the platform, along the outer perimeter of the platform, and a post unitary with the bottom wall and extending upwardly from the bottom wall, intermediate the end walls and intermediate the side walls, toward the platform for supporting the platform at a corresponding area of the platform located inside the outer perimeter of the platform.

4. The invention of claim 3 wherein the corresponding area of the platform is located generally centrally with respect to the outer perimeter of the platform and the post is located at a corresponding generally central location.

5. The invention of claim 4 wherein the post includes a support surface adjacent the corresponding area of the platform for supporting the platform along the corresponding area of the platform.

6. The invention of claim 5 including a relatively small gap between the support surface of the post and the corresponding area of the platform.

7. The invention of claim 6 wherein the platform is molded unitary with the end walls and the side walls along the entire outer perimeter of the platform.

8. The invention of claim 1 wherein the pallet is constructed for handling by a conventional fork-lift having a pair of tines and the basin includes a basal surface, first channels extending longitudinally along the basin adjacent the basal surface and second channels extending laterally across the basin adjacent the basal surface, the first and second channels being configured for receiving the tines of the fork-lift.

9. The invention of claim 1 wherein the basin includes a basal surface, a drain opening adjacent the basal surface for draining liquid from the reservoir, and an access opening adjacent the platform for receiving a cleaning medium for selective cleaning of the reservoir.

10. The invention of claim 1 wherein the predetermined area of the reinforcing support structure of the platform is at least sufficient to support four industrial drums of the fifty-five gallon size.

11. The invention of claim 1 wherein the basin has a volume at least as great as the volume of one of the industrial drums to be supported on the platform.

12. The invention of claim 1 wherein the platform includes a plurality of raised ribs extending generally parallel to one another and the troughs extend parallel to one another between the ribs.

13. The invention of claim 12 wherein the ribs extend longitudinally continuously along essentially the entire platform and are spaced laterally from one another.

14. The invention of claim 13 wherein the platform includes an outer perimeter, and the basin includes a bottom wall, and end walls and side walls extending between the bottom wall and the platform, along the outer perimeter of the platform, the platform being molded unitary with the end walls and the side walls along the entire outer perimeter of the platform.

15. The invention of claim 13 wherein the platform includes an outer perimeter, and the basin includes a bottom wall, and end walls and side walls extending between the bottom wall and the platform, along the outer perimeter of the platform, and a post unitary with the bottom wall and extending upwardly from the bottom wall, intermediate the end walls and intermediate the side walls, toward the platform for supporting the platform along a corresponding area of the platform located inside the outer perimeter of the platform.

16. The invention of claim 15 wherein the corresponding area of the platform is located generally centrally with respect to the outer perimeter of the platform and the post is located at a corresponding generally central location.

17. The invention of claim 16 wherein the post includes a support surface adjacent the corresponding area of the platform for supporting the platform along the corresponding area of the platform.

18. The invention of claim 17 including a relatively small gap between the support surface of the post and the corresponding area of the platform.

19. The invention of claim 18 wherein the platform is molded unitary with the end walls and the side walls along the entire outer perimeter of the platform.

20. The invention of claim 19 wherein the holes are relatively small in comparison to the area of the platform and are spaced apart so that the total area of the holes is small relative to the total area of the platform.

21. The invention of claim 19 wherein the ribs have a generally V-shaped cross-sectional configuration.

22. The invention of claim 19 wherein the predetermined area of the reinforcing support structure of the platform is at least sufficient to support four industrial drums of the fifty-five gallon size.

23. The invention of claim 19 wherein the basin has a volume at least as great as the volume of one of the industrial drums to be supported on the platform.

24. The invention of claim 1 wherein the holes are relatively small in comparison to the area of the platform and are spaced apart so that the total area of the holes is small relative to the total area of the platform.

* * * * *